US008993059B2

(12) United States Patent
Price et al.

(10) Patent No.: US 8,993,059 B2
(45) **Date of Patent: *Mar. 31, 2015**

(54) METHOD OF MAKING MORPHOLOGICALLY PATTERNED COATINGS

(75) Inventors: Peter E. Price, Minneapolis, MN (US); William B. Kolb, West Lakeland, MN (US); Mikhail L. Pekurovsky, Bloomington, MN (US); Steven D. Solomonson, Shoreview, MN (US); Mitchell A. F. Johnson, Maplewood, MN (US)

(73) Assignee: 3M Innovative Properties, Company, St. Paul, MN (US)

( * ) Notice: Subject to any disclaimer, the term of this patent is extended or adjusted under 35 U.S.C. 154(b) by 1906 days.

This patent is subject to a terminal disclaimer.

(21) Appl. No.: 11/815,468

(22) PCT Filed: Feb. 14, 2006

(86) PCT No.: PCT/US2006/005059

§ 371 (c)(1), (2), (4) Date: Aug. 3, 2007

(87) PCT Pub. No.: WO2006/088804

PCT Pub. Date: Aug. 24, 2006

(65) Prior Publication Data

US 2008/0138521 A1 Jun. 12, 2008

Related U.S. Application Data

(60) Provisional application No. 60/653,360, filed on Feb. 16, 2005.

(51) Int. Cl.

| | |
|---|---|
| ***B05D 5/00*** | (2006.01) |
| ***B05D 3/02*** | (2006.01) |
| ***B05D 3/06*** | (2006.01) |
| ***B05D 5/02*** | (2006.01) |
| *B05D 1/32* | (2006.01) |

(52) U.S. Cl.

CPC ..... *B05D 3/0254* (2013.01); *B05D 3/067* (2013.01); *B05D 5/02* (2013.01); *B05D 1/32* (2013.01)

USPC ..... 427/256; 427/487; 430/311

(58) Field of Classification Search

USPC ..... 427/256, 487; 430/311

See application file for complete search history.

(56) References Cited

U.S. PATENT DOCUMENTS

| | | | | |
|---|---|---|---|---|
| 3,544,790 | A | 12/1970 | Brown | |
| 3,788,846 | A | 1/1974 | Mayaud et al. | |
| 3,788,876 | A * | 1/1974 | Baker | 229/132 |

(Continued)

FOREIGN PATENT DOCUMENTS

| | | |
|---|---|---|
| DE | 1 497 404 | 8/1969 |
| GB | 2 237 657 | 5/1991 |

(Continued)

*Primary Examiner* — Shamim Ahmed

(74) *Attorney, Agent, or Firm* — James A. Baker; Douglas B. Little

(57) ABSTRACT

Methods of forming patterned coatings are disclosed. The methods include the steps of disposing a composition onto a substrate to form a liquid coating on the substrate and providing or removing energy through a first pattern of areas on the coated film to form a morphologically patterned coating, the morphological pattern corresponding to the first pattern of areas.

16 Claims, 7 Drawing Sheets

(56) References Cited

U.S. PATENT DOCUMENTS

| | | | | |
|---|---|---|---|---|
| 3,911,191 | A * | 10/1975 | Guastella et al. | 428/342 |
| 4,698,914 | A * | 10/1987 | Shu et al. | 34/370 |
| 5,060,396 | A | 10/1991 | Hansen | |
| 5,520,993 | A * | 5/1996 | Lambert | 428/215 |
| 5,581,905 | A | 12/1996 | Huelsman et al. | |
| 5,694,701 | A | 12/1997 | Huelsman et al. | |
| 6,069,219 | A | 5/2000 | McCormick et al. | |
| 6,078,713 | A * | 6/2000 | Tausch et al. | 385/115 |
| 6,242,504 | B1 * | 6/2001 | Meyer-Roscher et al. | 522/2 |
| 6,296,732 | B1 * | 10/2001 | Enlow et al. | 156/209 |
| 6,299,799 | B1 | 10/2001 | Craig et al. | |
| 6,352,758 | B1 | 3/2002 | Huang et al. | |
| 6,372,407 | B1 | 4/2002 | Liu et al. | |
| 6,391,217 | B2 * | 5/2002 | Schaffer et al. | 216/41 |
| 6,444,378 | B1 | 9/2002 | Johnson | |
| 6,660,363 | B1 | 12/2003 | Barthlott | |
| 6,957,608 | B1 * | 10/2005 | Hubert et al. | 101/483 |
| 7,115,216 | B2 * | 10/2006 | Carter et al. | 252/301.16 |
| 8,182,871 | B2 * | 5/2012 | Price et al. | 427/256 |
| 2001/0006766 | A1 | 7/2001 | O'Brien et al. | |
| 2001/0055042 | A1 * | 12/2001 | Matsumoto et al. | 347/19 |
| 2003/0124360 | A1 | 7/2003 | Reihs et al. | |
| 2003/0194497 | A1 * | 10/2003 | Takada et al. | 427/355 |
| 2003/0229163 | A1 * | 12/2003 | Araki | 524/88 |
| 2004/0191671 | A1 * | 9/2004 | Hsu | 430/270.1 |
| 2004/0197578 | A1 * | 10/2004 | Sinsel et al. | 428/461 |

FOREIGN PATENT DOCUMENTS

| | | | |
|---|---|---|---|
| WO | WO 94/20223 | A1 | 9/1994 |
| WO | WO 96/04123 | A1 | 2/1996 |
| WO | WO 01/16370 | A1 | 3/2001 |
| WO | WO 01/92179 | A1 | 12/2001 |
| WO | WO 03/013827 | A1 | 2/2003 |
| WO | WO 03/099953 | A1 | 12/2003 |

* cited by examiner

100 μm

100 μm

METHOD OF MAKING MORPHOLOGICALLY PATTERNED COATINGS

CROSS REFERENCE TO RELATED APPLICATIONS

This application is a national stage filing under 35 U.S.C. §371 of PCT/US2006/005059, filed Feb. 14, 2006, which claims priority to Provisional Application No. 60/653,360 filed Feb. 16, 2005.

BACKGROUND

The present invention generally relates to methods of making patterned coatings. The present invention more particularly relates to methods of making patterned coatings by providing a pattern of energy to or removing a pattern of energy from a liquid coating and solidifying the resulting patterned coating.

Many industrial and consumer products contain layers of material that are created by disposing a liquid coating onto another material and then solidifying the liquid coating. In many cases, the material that forms such a layer is itself a complex system containing multiple components and phases. Examples of such layers include magnetic media and abrasive sheets. In other cases, the solid material that forms the layer may be nominally uniform in chemical composition but contain some other internal structure, such as molecular alignment or pores. Examples of such structures include polarizing films and porous membranes. The structure or form within such a layer is its morphology.

When such layers are formed from a liquid coating that contains volatile components, typically organic solvents, and those volatile components are subsequently removed or dried, the choice of initial formulation and drying conditions affect the final morphology of the layer.

When significant flow occurs in the liquid coating, as sometimes happens during solidification, the final morphology of the solid layer may be affected. It is often the case that such effects are considered defects in the final layer.

SUMMARY

Generally, the present invention relates to methods of making patterned coatings. The present invention more particularly relates to methods of making patterned coatings by providing a pattern of energy to or removing a pattern of energy from a liquid coating and solidifying the resulting patterned coating.

In one embodiment, a method of forming a patterned coating includes the steps of disposing a composition onto a substrate to form a liquid coating on the substrate and providing energy through a first pattern of areas on the liquid coating to form a morphologically patterned coating, the morphological pattern corresponding to the first pattern of areas.

In a further embodiment, a method of forming a patterned coating includes the steps of disposing a composition onto a substrate to form a liquid coating on the substrate and removing energy through a first pattern of areas on the liquid coating to form a morphologically patterned coating, the morphological pattern corresponding to the first pattern of areas.

These and other aspects of the present application will be apparent from the detailed description below. In no event, however, should the above summaries be construed as limitations on the claimed subject matter, which subject matter is defined solely by the attached claims, as may be amended during prosecution.

DETAILED DESCRIPTION

Figure 1:
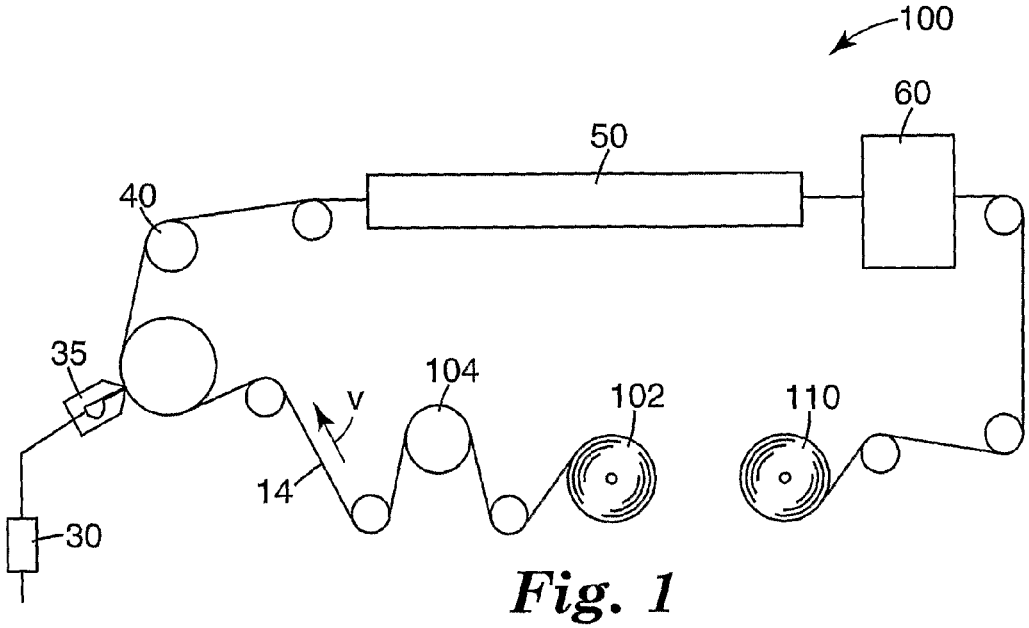
FIG. 1 is a schematic diagram of an exemplary continuous process for making a patterned coating.

The methods of making patterned coatings of the present invention are believed to be applicable to a variety of applications that utilize patterned coatings. In some embodiments, a morphologically patterned coating is formed by removing or providing energy through a corresponding pattern of areas on the coating. These examples, and the examples discussed below, provide an appreciation of the applicability of the disclosed, but should not be interpreted in a limiting sense.

The term "coating" refers to material disposed upon a material.

The term "area" may refer either to a two-dimensional surface, such as a material interface, or a region or portion of material. The appropriate definition is determined in context.

Unless otherwise indicated, the term "polymer" will be understood to include polymers, copolymers (e.g., polymers formed using two or more different monomers), oligomers and combinations thereof, as well as polymers, oligomers, or copolymers. Both block and random copolymers are included, unless indicated otherwise.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought by those skilled in the art utilizing the teachings disclosed herein.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5) and any range within that range.

As used in this specification and the appended claims, the singular forms "a", "an", and "the" include plural referents unless the content clearly dictates otherwise. Thus, for example, reference to a composition containing "a polymer" includes two or more polymers. As used in this specification and the appended claims, the term "or" is generally employed in its sense including "and/or" unless the content clearly dictates otherwise.

The term "liquid" refers to a material that deforms continuously when subjected to a shear stress. It is recognized that liquids in the current context may contain particles or regions of solid materials as, for example, in a slurry, suspension, or dispersion.

The term "pattern" refers to a spatially varying structure. The term "pattern" includes a uniform or periodic pattern, a varying pattern, a random pattern, and the like.

The term "solid(s)" refers to material(s) that is/are included in the solidified coating, including components such as monomers that are initially liquid.

The term "morphological" or "morphologically" refers to a material property of a solid layer such as, for example, density, chemical composition, crystallinity, molecular orientation, porosity, and the like.

This disclosure generally describes methods of making patterned coatings. The present application more particularly relates to methods of making patterned coatings by applying a pattern of energy to or removing a pattern of energy from a liquid coating and solidifying the resulting morphologically patterned coating. In many embodiments, the patterned coatings are formed without the coating physically contacting a replication tool. In some embodiments, the resulting coating pattern contains pattern elements that occur by natural instabilities.

In some embodiments, a method of forming a patterned coating includes the steps of disposing a composition onto a substrate to form a liquid coating on the substrate. The coating composition can include any material useful in forming a film. The substrate can be any material useful for supporting film formation.

In some embodiments, the coating composition is a solution of film forming material or polymeric resin in a liquid vehicle. A partial listing of useful polymers includes; acetals, acrylics, acetates, cellulosics, fluorocarbons, amides, ethers, carbonates, esters, styrenes, urethanes, sulfones, gelatins, and the like. The polymers can be homopolymers or they can be copolymers formed from two or more monomers. Liquid vehicles for use in the coating composition can be chosen from a wide range of suitable materials. For example, the coating composition can be an aqueous composition or an organic solution comprising an organic solvent.

In some embodiments, the film forming material forms a pressure sensitive adhesive. In some embodiments, the pressure sensitive adhesive is a block copolymer pressure sensitive adhesive, a tackified elastomer pressure sensitive adhesive, a water-based latex pressure sensitive adhesive, an acrylate-based pressure sensitive adhesive, or a silicon-based pressure sensitive adhesive.

In some embodiments, the film forming material forms an optical film. Examples of optical films include compensation films, retardation films, brightness enhancing films, diffuser films, and the like. Optical film can be formed from any useful polymer such as, for example, olefins, acrylates, cellulosics, fluorocarbons, carbonates, and the like.

In some embodiments, organic solvents include ketones such as acetone or methyl ethyl ketone, hydrocarbons such as benzene or toluene, alcohols such as methanol or isopropanol, halogenated alkanes such as ethylene dichloride or propylene dichloride, esters such as ethyl acetate or butyl acetate, and the like. Combinations of two or more organic solvents can, of course, be utilized as the liquid vehicle or the liquid vehicle can be a mixed aqueous-organic system. In some embodiments, water is the liquid vehicle.

In some embodiments, the coated layer includes a solid phase material. The solid phase material can include discrete solid phase particles having a mean diameter in a range from 5 nanometers to 1 millimeter. In some embodiments, the solid phase material is nanoparticles. In one embodiment, the solid phase material is silica nanoparticles having a mean diameter in a range from 5 to 75 nanometers. In other embodiments, the solid phase material is zirconia, diamond, or solid discrete polymer beads such as, for example, polymethyl methacrylate (PMMA).

In some embodiments, the weight percentage of solids in the coating composition can be 0.1 to 100%, or 1 to 40% or 1 to 20%. In some embodiments, the coating composition is 100% monomer. The coating composition has a viscosity such that it is flowable. The viscosity will depend on the type of coating apparatus employed and can be up to 10,000 centipoise or more, or in the range from about 0.1 to about 1000 centipoise, or from 0.1 to 100 centipoise, or from 0.5 to 10 centipoise, or from 1 to 5 centipoise.

The substrate upon which the coating composition is disposed can be composed of any material whatever, as long as it is a material that allows suitable disposition of the liquid coating composition. In some embodiments, it is a sheet material that is coated as a continuous web in a continuous coating process. In other embodiments, it is in a discrete form such as separate sheets carried through the coating and drying zones by a conveyor belt or similar device. Useful substrates include, for example, polymeric films such as films of polyesters, polyolefins or cellulose esters; metal foils such as aluminum or lead foils, paper, polymer-coated paper such as polyethylene-coated paper; rubber, and laminates having various layers of polymers or of polymer and metal foil.

Any suitable type of coating apparatus can be used to dispose one or more coating compositions (onto each other or next to each other) onto the substrate. Thus, for example, the coating composition can be disposed by dip coating, forward and reverse roll coating, wire wound rod coating, and die type coating. Die coaters include knife coaters, slot coaters, slide coaters, slide curtain coaters, drop die curtain coaters, and extrusion coaters among others. In some embodiments, one or more coating compositions can be "strip" coated onto the substrate. Wet coverage of the coating composition is also a matter of choice and will depend upon many factors such as the type of coating apparatus employed, the characteristics of the coating composition, and the desired thickness of the coating after drying.

The disposed coating composition can have any useful wet thickness. In some embodiments, the liquid coating has a wet thickness in a range from 0.5 to 5000 micrometers, or 1 to 1000 micrometers, or 10 to 1000 micrometers, or 50 to 100 micrometers, or 100 to 1000 micrometers. In other embodiments, liquid coating has a wet thickness in a range from 5 to 1000 nanometers, or from 50 to 250 nanometers. In many embodiments, the disposed coating composition has a nominally uniform wet thickness.

The coating can be morphologically patterned by removing energy from or providing energy to the liquid coating. Energy can be provided or removed through a first pattern of areas on the liquid coating to form a morphologically patterned coating, the morphological pattern corresponding to the first pattern of areas. The morphologically patterned coating can then be solidified by, for example, drying, freezing, polymerizing, cross-linking, or curing the morphologically patterned coating. In some embodiments, the morphologically patterned coating is subjected to other processing prior to solidification. In some embodiments, the morphologically patterned coating is not solidified.

Energy can be provided through a pattern of areas on the liquid coating by a variety of means. In some embodiments, an energy source directs energy directly onto the liquid coating such that the liquid coating is disposed between the energy source and the substrate. In some embodiments, the substrate is disposed between the energy source and the liquid coating. In some embodiments, an energy transfer surface contacts the substrate and provides energy to the liquid coating through the substrate. In some embodiments, the energy transfer surface is substantially smooth and energy is provided through a pattern of areas on the liquid coating. In other embodiments, the energy transfer surface is patterned or not smooth and energy is provided through a pattern of areas on the liquid coating.

In some embodiments, the energy source is a photonic energy source. The photonic energy source can direct photonic energy directly through a first pattern of areas on the liquid coating. In some embodiments, the photonic energy source is an infrared energy source. In another embodiment, the photonic energy source is a laser energy source.

Energy can be removed through a pattern of areas on the liquid coating by a variety of means. In some embodiments, an energy transfer surface contacts the substrate and removes energy from the liquid coating through the substrate. In some embodiments, the energy transfer surface is substantially smooth and energy is removed through a pattern of areas on the liquid coating. In other embodiments, the energy transfer surface is patterned or not smooth and energy is removed through a pattern of areas on the liquid coating. In some embodiments, energy can be provided to and removed from the liquid coating simultaneously or sequentially. In one embodiment, energy is provided through one side of the liquid coating and energy is removed through an opposite side of the liquid coating simultaneously to form the morphologically patterned coating.

Energy can be removed from or provided to the liquid coating in any amount effective to create the morphological features. In some embodiments, an amount of energy is purposefully provided to or removed from the liquid coating to create a temperature difference between the pattern of areas where energy is provided or removed and the remaining areas. This temperature difference can be any useful temperature difference, for example, from greater than 0.1 degree Celsius, or from 0.1 to 100 degrees Celsius, or 1 to 50 degrees Celsius, or 5 to 50 degrees Celsius.

In some embodiments, the morphological pattern of areas is a pattern of areas having a density that differs from the remaining areas of the coating. In some embodiments, the morphological pattern of areas is a pattern of areas having a composition different than the remaining areas of the coating.

Morphological features formed in the coating can be any useful size and specifically determined by the pattern of areas where energy is provided to or removed from the liquid coating.

Prior to or during the formation of the morphological pattern of areas, the environment above and/or below the liquid coating and substrate may be controlled to establish an appropriate coating state for pattern formation. In some embodiments, such environmental control could include control of gas phase temperature, or gas phase composition, or gas phase velocity in order to add or remove or impede removal of components from the liquid coating, or in order to induce reactions in the coating, or in order to melt or modify the viscosity of the coating, or the like. In some embodiments, such environmental control includes providing a thermally controlled contact surface, such as a heated or chilled roll or plate, or providing a radiative energy source, such as an infrared source, or providing a reaction-inducing energy source, such as an ultraviolet source, or the like. Such methods for controlling the environment around a coated substrate are known to those skilled in the art.

Following or during the formation of the morphological pattern of areas, the coating can be dried. Drying coated substrates, such as webs, typically requires heating the coated substrate to cause volatile components to evaporate from the coating. The evaporated material is then removed. In some embodiments, drying is accomplished via conventional drying techniques. One conventional drying technique is impingement drying. Impingement drying systems for coated substrates utilize one or two-sided impingement dryer technology to impinge air to one or both sides of a moving coated substrate. In such conventional impingement dryer systems, air supports and heats the coated substrate and can supply energy to both the coated and non-coated sides of the substrate. In a conventional gap drying system, such as taught in the Huelsman et al. U.S. Pat. No. 5,581,905 and the Huelsman et al. U.S. Pat. No. 5,694,701, which are herein incorporated by reference, a coated substrate, such as a web, moves through the gap drying system without contacting solid surfaces. In one gap drying system configuration, energy is supplied to the backside of the moving web to evaporate solvent and a chilled platen is disposed above the moving web to remove the solvent by condensation. The gap drying system provides for solvent recovery, reduced solvent emissions to the environment, and a controlled and relatively inexpensive drying system. In the gap drying system, the web is transported through the drying system supported by a fluid, such as air, which avoids scratches on the web. As is the case for impingement dryer systems, previous systems for conveying a moving web without contacting the web typically employ air jet nozzles that impinge an air jet against the web. Most of the energy is transferred to the backside of the web by convection because of the high velocity of air flow from the air jet nozzles. Many impingement dryer systems can also transfer energy to the front side of the coated web.

Substrates that have been coated can be dried using a drying oven that contains a drying gas. The drying gas, usually air, is heated to a suitable elevated temperature and brought into contact with the coated substrate in order to bring about evaporation of the solvent. The drying gas can be introduced into the drying oven in a variety of ways. In some systems, the drying gas is directed in a manner that distributes it uniformly over the surface of the coated substrate under carefully controlled conditions that are designed to result in a minimum amount of disturbance of the coating. The spent drying gas, that is, drying gas that has become laden with solvent vapor evaporated from the coating, is continuously discharged from the dryer. Many industrial dryers use a number of individually isolated zones to allow for flexibility in drying characteristics along the drying path. For example, U.S. Pat. No. 5,060,396 describes a zoned cylindrical dryer for removing solvents from a traveling coated substrate. The multiple drying zones are physically separated, and each drying zone may operate at a different temperature and pressure. Multiple drying zones can be desirable because they permit the use of graded drying gas temperature and solvent vapor composition.

The morphologially patterned coating can be further processed, as desired. In some embodiments, the morphologially patterned coating includes curable components that can be cured via a thermal or light curing process.

FIG. 1 is a schematic diagram (not to scale) of an exemplary continuous process 100 for making a patterned coating. This process 100 includes an unwind station 102, a velocity control roll 104, a drying station 50, a UV curing station 60, and a rewind station 110. Additional idler rolls can be used for web transport, as needed. The web or substrate 14 is transported through the process 100 at speed v. A coating die 35 disposes a coating composition to the substrate 14. A pump 30 can supply the coating die with the coating composition. The liquid coating can then be patterned with a temperature controlled patterned roll 40 in thermal communication with the uncoated side of the substrate 14. The patterned roll 40 can have a pyramidal knurl with a pitch of 63 lines per centimeter and a pitch angle, d, of 45 degrees (see FIG. 3.) The roll diameter can be 11.4 cm.

Figure 3:
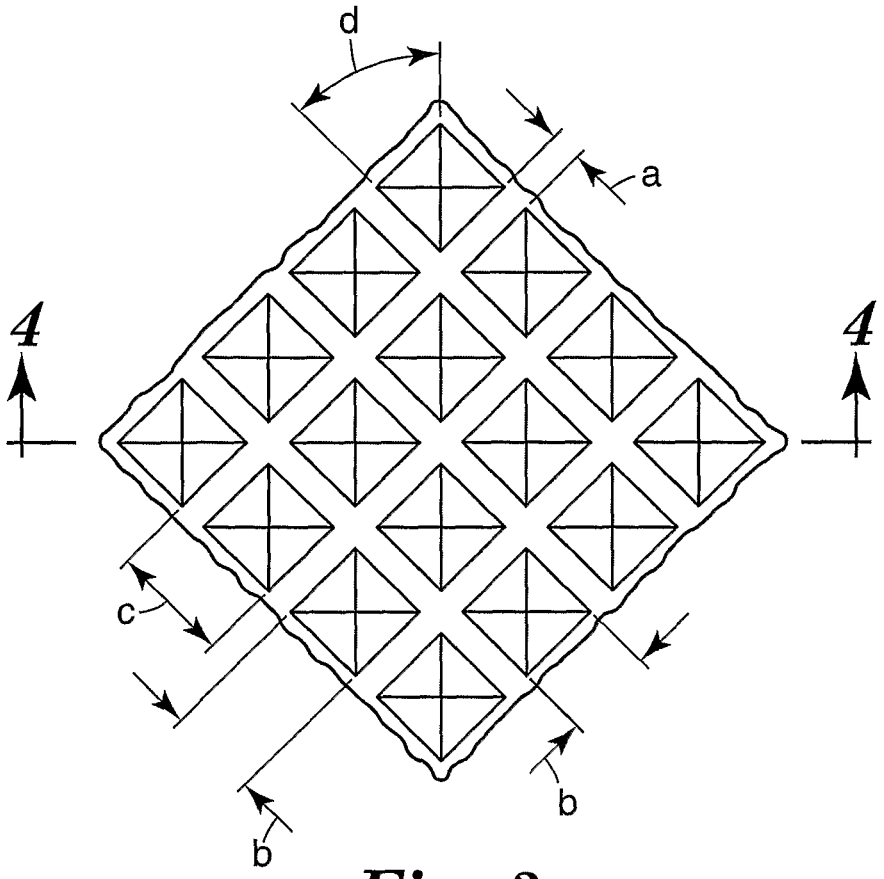
FIG. 3 is a top view schematic diagram of an energy transfer surface pattern.
Figure 4:
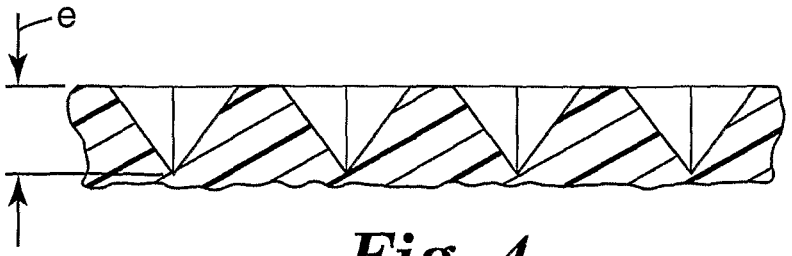
FIG. 4 is a cross-section schematic diagram of the energy transfer surface pattern taken along line 4-4.

A top view schematic diagram of an exemplary energy transfer surface pattern is shown in FIG. 3. The pattern dimensions can include a land width, a, of 63 micrometers and a cell side length, b, of 95 micrometers, resulting in a pattern period, c, of 158 micrometers. The internal angle (not labeled) of the cell is 70 degrees. FIG. 4 is a cross-section schematic diagram of the energy transfer surface pattern shown in FIG. 3, taken along line 4-4. The cell depth, e, is 69 micrometers.

Figure 2:
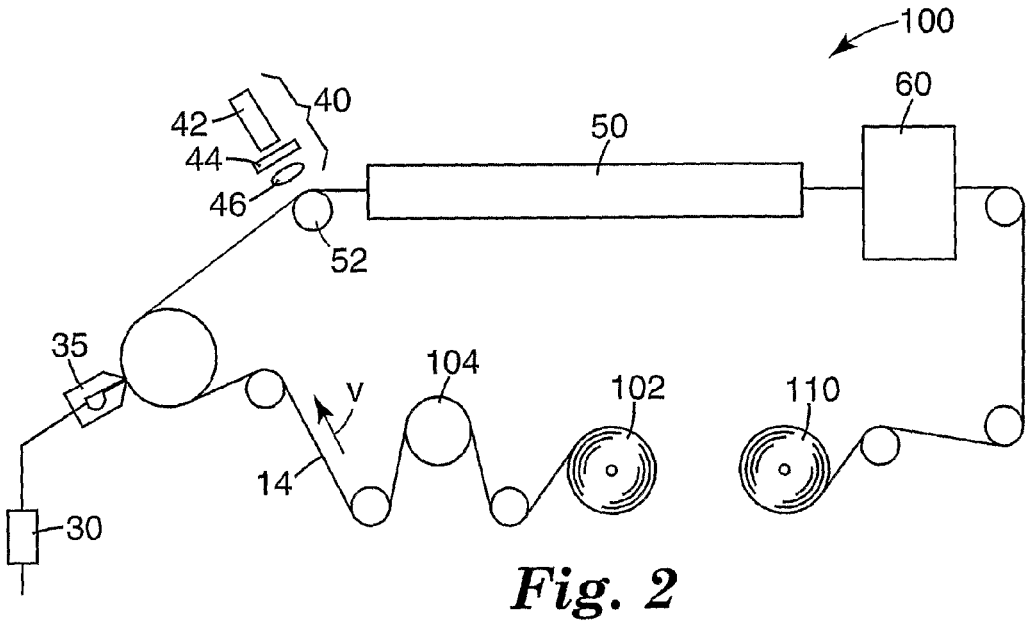
FIG. 2 is a schematic diagram of another exemplary continuous process for making a patterned coating.

FIG. 2 is a schematic diagram (not to scale) of another exemplary continuous process 100 for making a patterned coating. This process 100 includes an unwind station 102, a velocity control roll 104, a drying station 50, a UV curing station 60, and a rewind station 110. Additional idler rolls can be used for web transport, as needed. The web or substrate 14 is transported through the process 100 at speed v. A coating die 35 disposes a coating composition to the substrate 14. A pump 30 can supply the coating die with the coating composition. The liquid coating can then be patterned with a laser system 40. The laser system 40 can include a laser 42, a mechanical chopper 44 and a focusing lens 46. The uncoated side of the substrate 14 can be in contact with a support roll 52.

EXAMPLES

Materials

CAB 171-15s: cellulose-acetate-butyrate (Eastman Chemical Company, Kingsport, Tenn.) White wax beads: 20% R104 TiO2 and 80% Polywax 1000 (Baker Petrolite, Sugar Land, Tex.)

Syloid 803: micro-sized silica gel, manufactured by Grace Davidson WR Grace & Co., Baltimore Md. 21203

Butvar B-79, polyvinyl butyral (Solutia Inc., St. Louis, Mo.)

Example 1

Figure 5:
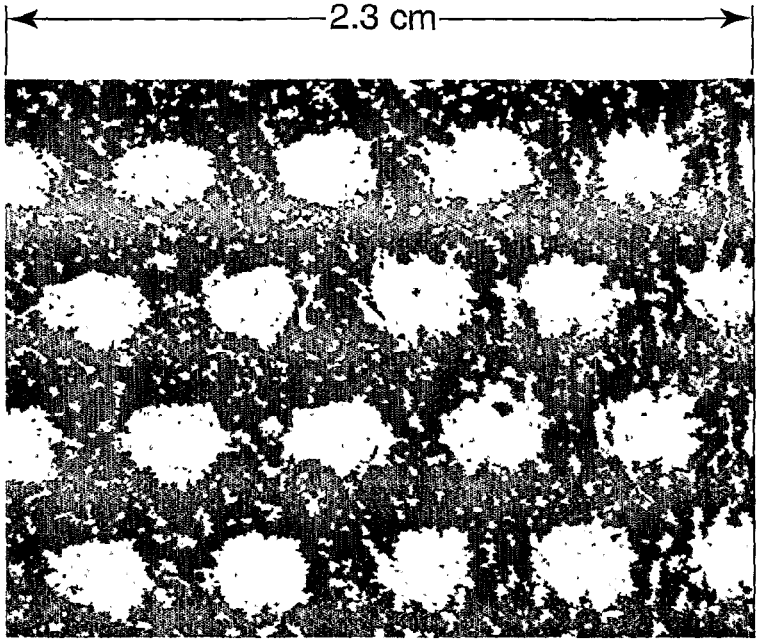
FIG. 5 is an optical micrograph of a patterned coating formed according to Example 1.

A morphologically patterned coating was prepared from a mixture containing 4.1% cellulose-acetate-butyrate (CAB 171-15s), 4.8% white wax beads, and 91.1% acetone. The mixture was disposed onto a 48 micrometer thickness clear polyester film using a BWK Gardner Multiple Clearance Applicator with a gap setting of 508 micrometers. The dry coating weight was approximately 15.9 grams/meter$^2$. The coated film was then placed (coating facing upward) onto a 9.5 mm thick silicone rubber sheet. A 1.1 mm thick aluminum plate that had been drilled with a staggered array of holes 3.2 mm in diameter and nearest neighbor center-to-center spacing of 4.8 mm was positioned approximately 3 mm above the coated film using glass sides as spacers at the corners of the coated film. A Watlow RAYMAX Model 1525 infrared heater set at full power was positioned approximately 23 cm above the aluminum plate. The coating on the film was then allowed to dry for approximately 5 minutes. The patterned thermal treatment caused the wax beads to concentrate in generally circular areas corresponding to the holes in the aluminum plate in location and scale. An optical micrograph of the dried, patterned coating is shown in FIG. 5.

Example 2

Figure 6:
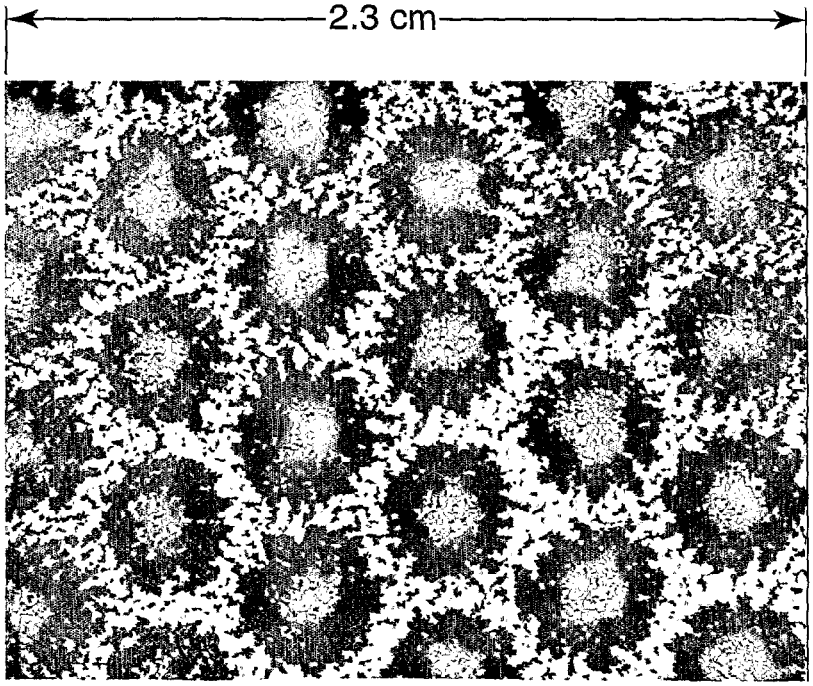
FIG. 6 is an optical micrograph of a patterned coating formed according to Example 2.

A morphologically patterned coating was prepared from the suspension of white wax beads in CAB and acetone described in Example 1. The suspension was disposed onto a 48 micrometer thickness clear polyester film using a BWK Gardner Multiple Clearance Applicator with a gap setting of 508 micrometers. The dry coating weight was approximately 15.9 grams/meter$^2$. The coated film was then placed (coating facing upward) onto a 1.1 mm thick aluminum plate that had been drilled with a staggered array of holes 3.2 mm in diameter and nearest neighbor center-to-center spacing of 4.8 mm. The aluminum plate was then chilled to 110° C. The coating on the film was then allowed to dry for approximately 15 minutes. The patterned thermal treatment caused the white wax beads to concentrate in areas corresponding to the land areas in between the holes in the aluminum plate. A micrograph of the dried, patterned coating is shown in FIG. 6.

Example 3

Figure 7:
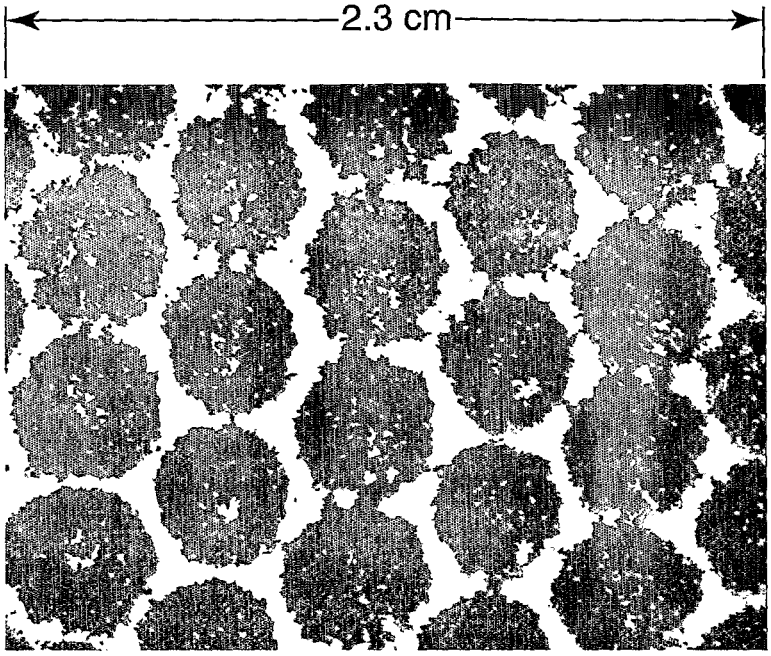
FIG. 7 is an optical micrograph of a patterned coating formed according to Example 3.

A morphologically patterned coating was prepared from the suspension of white wax beads in CAB and acetone described in Example 1. The suspension was disposed onto a 48 micrometer thickness clear polyester film using a BWK Gardner Multiple Clearance Applicator with a gap setting of 508 micrometers. The dry coating weight was approximately 15.9 grams/meter$^2$. The coated film was then placed (coating facing upward) onto a 1.1 mm thick aluminum plate that had been drilled with a staggered array of holes 3.2 mm in diameter and nearest neighbor center-to-center spacing of 4.8 mm. The aluminum plate was placed onto a temperature-controlled hot plate and heated to 50° C. The coating on the film was then allowed to dry for approximately 5 minutes. The patterned thermal treatment caused the white wax beads to concentrate in areas corresponding to the land areas in between the holes in the aluminum plate. A micrograph of the dried, patterned coating is shown in FIG. 7.

Example 4

Figure 8:
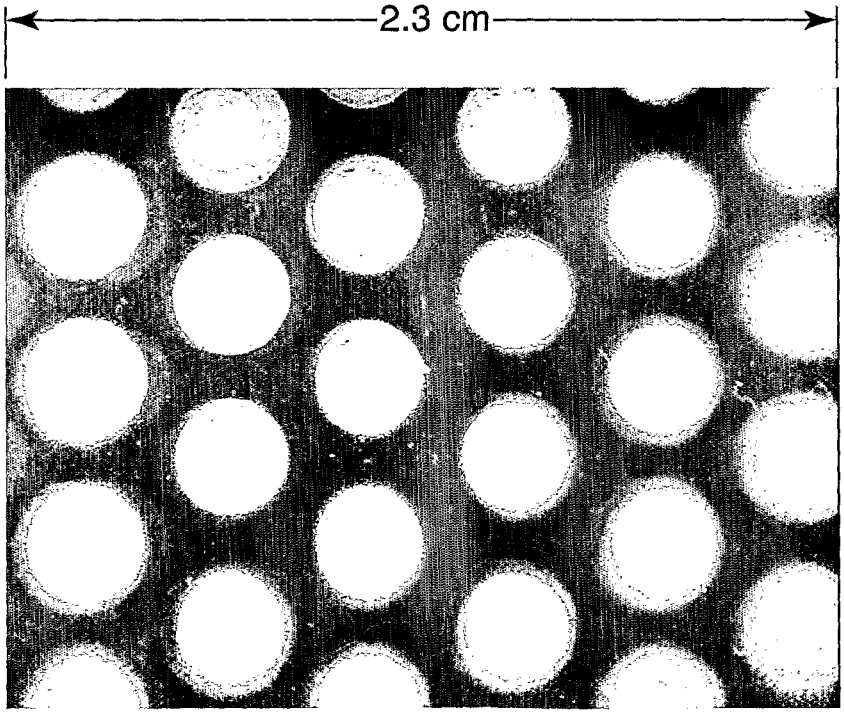
FIG. 8 is an optical micrograph of a patterned coating formed according to Example 4.

A morphologically patterned coating was prepared by disposing a solution consisting of a 10% CAB, 3% water, and 87% acetone onto a 48 micrometer thickness clear polyester film using a BWK Gardner Multiple Clearance Applicator with a gap setting of 203 micrometers. The dry coating weight was approximately 7.1 grams/meter$^2$. The coated film was then placed (coating facing upward) onto a 1.1 mm thick aluminum plate that had been drilled with a staggered array of holes 3.2 mm in diameter and nearest neighbor center-to-center spacing of 4.8 mm. The aluminum plate was placed onto a temperature-controlled hot plate and heated to 71° C. The coating on the film was then allowed to dry for approximately 5 minutes. The patterned thermal treatment resulted in porous regions corresponding to the holes in the aluminum plate and dense polymer regions corresponding to the remaining area. A micrograph of the dried, patterned coating is shown in FIG. 8.

Example 5

Figure 9:
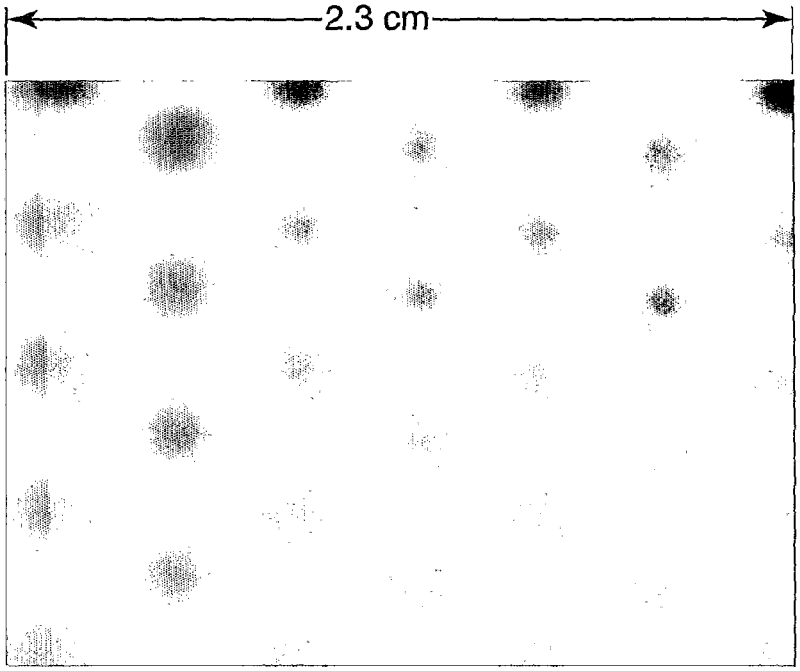
FIG. 9 is an optical micrograph of a patterned coating formed according to Example 5.

A morphologically patterned coating was prepared by disposing a solution consisting of a 10% CAB, 3% water, and 87% acetone onto a 48 micrometer thickness clear polyester film using a BWK Gardner Multiple Clearance Applicator with a gap setting of 254 micrometers. The dry coating weight was approximately 7.7 grams/meter$^2$. The coated film was then placed (coating facing upward) onto a 9.5 mm thick silicone rubber sheet. A 1.1 mm thick aluminum plate that had been drilled with a staggered array of holes 3.2 mm in diameter and nearest neighbor center-to-center spacing of 4.8 nm was positioned approximately 3 mm above the coated film using glass sides as spacers at the corners of the coated film. A Watlow RAYMAX Model 1525 infrared heater set at full power was positioned approximately 15 cm above the aluminum plate. The coating on the film was then allowed to dry for approximately 5 minutes. The patterned thermal treatment caused porous regions to form in areas corresponding to the land areas in between the holes in the aluminum plate. A micrograph of the dried, patterned coating is shown in FIG. 9.

Example 6

A morphologically and topographically patterned "bead coating" was prepared by disposing a solution consisting of 19.1% UV curable acrylate, 80% 2-butanone and 0.9% Syloid 803 (3 micrometer polymethylmethacrylate beads) using a process illustrated in FIG. 1. The solution was supplied to coating die 35 at a rate of 10 cm$^3$/min by pump 30. The suspension was disposed uniformly through a 10.2 cm wide coating die 35 to substrate 14 moving at a speed v of 10.2 cm/sec. The substrate 14 was PET, 15.2 cm wide and 14.2 micrometers in thickness. The bead suspension was patterned by transporting coated substrate 14 "over" a temperature controlled patterned roll 40. The substrate 14 wraps patterning roll 40 approximately 37 degrees (portion of substrate in thermal communication with roll 40). Roll 40 temperature was measured to be approximately 55 degrees Celsius. Patterned beaded coating was then transported through dryer 50 and UV cure station 60 and wound up at rewind station 110.

Figure 10:
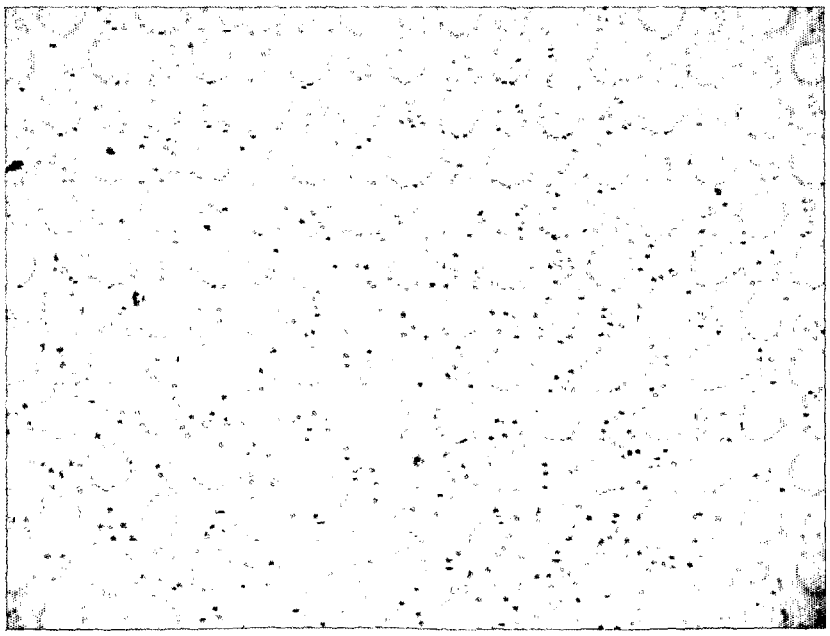
FIG. 10 is an optical micrograph of a patterned coating formed according to Example 6.

The patterned bead containing coating was imaged using an Olympus BX-51 microscope with Differential Interference Contrast (DIC) optics and 10× objective as shown in FIG. 10.

Example 7

A morphologically and topographically patterned coating was prepared by disposing a solution consisting of 5.1 weight % CAB, 16.1 weight % water and 78.8 weight % acetone, using a process illustrated in FIG. 1. The solution was supplied to coating die 35 at a rate of 7 cm$^3$/min by pump 30. The solution was disposed uniformly through a 10.2 cm wide coating die 35 to substrate 14 moving at a speed v of 5.1 cm/sec. The substrate 14 was PET 15.2 cm wide and 14.2 micrometers in thickness. The solution was patterned by transporting coated substrate 14 "over" temperature controlled patterned roll 40. The substrate 14 wraps patterning roll 40 approximately 80 degrees (portion of substrate in thermal communication with roll 40). Roll 40 temperature was measured to be approximately 55 degrees Celsius. Patterned coating was then transported through dryer 50 and UV cure station 60 and wound up at rewind station 110.

Figure 11:
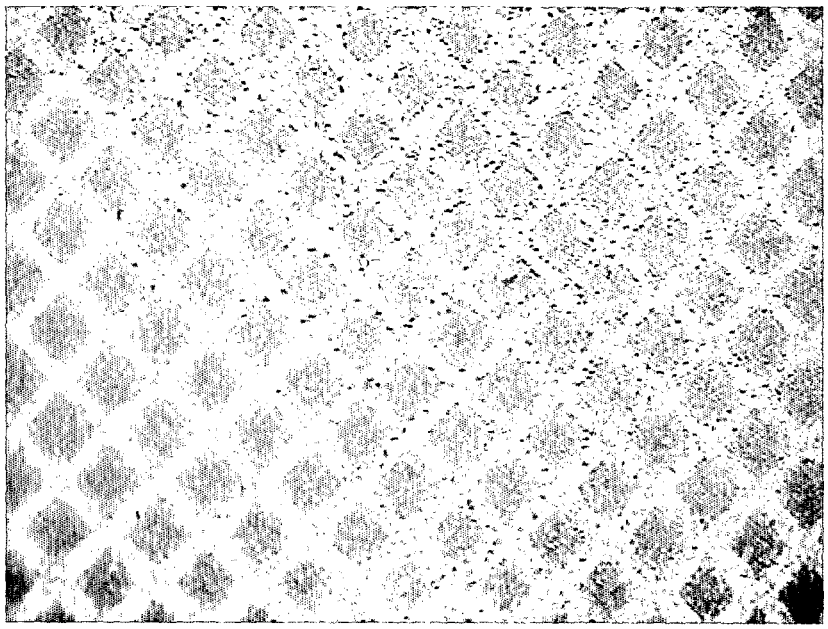
FIG. 11 is an optical micrograph of a patterned coating formed according to Example 7.

The patterned coating was imaged using an Olympus BX-51 microscope with brightfield illumination using 10× objective as shown in FIG. 11.

Example 8

A patterned coating was prepared by disposing a UV curable acrylate hardcoat solution (essentially formed as described in Example 3 of U.S. Pat. No. 6,299,799) containing 3 micrometer Syloid silica beads (29.8% acrylate, 36% toluene, 33.6% 2-propanol and 0.6% Syloid 803) and using a process illustrated in FIG. 2. The solution was supplied to coating die 35 at a rate of 4 cm$^3$/min by pump 30. The solution was disposed uniformly through a 10.2 cm wide coating die 35 to substrate 14 moving at a speed v of 5.1 cm/sec. The substrate 14 was transparent PET 15.2 cm wide and 50.8 micrometers in thickness. The solution was patterned by exposing the coated substrate 14 to a mechanically chopped and focused beam of infrared radiation as it was transported "over" smooth idler roll 52. Laser 42, (100 mW, 780-1150 nm wavelength diode laser manufactured by Lasermax Inc., 3495 Winton PI Bldg.8, Rochester N.Y. 14623) was chopped with a mechanical chopping wheel, 44, and focused with focusing lens 46. Smooth idler roll 52, consisted of an aluminum shell with an outside diameter of 8.9 cm and a 200 micrometer thick layer of black colored insulating material (3M Scotch™ Super 33+ Vinyl Electrical Tape 30-0665) wrapping the outer surface. Patterned coating was then transported through dryer 50 and UV cure station 60 and wound up at rewind station 110.

Figure 12:
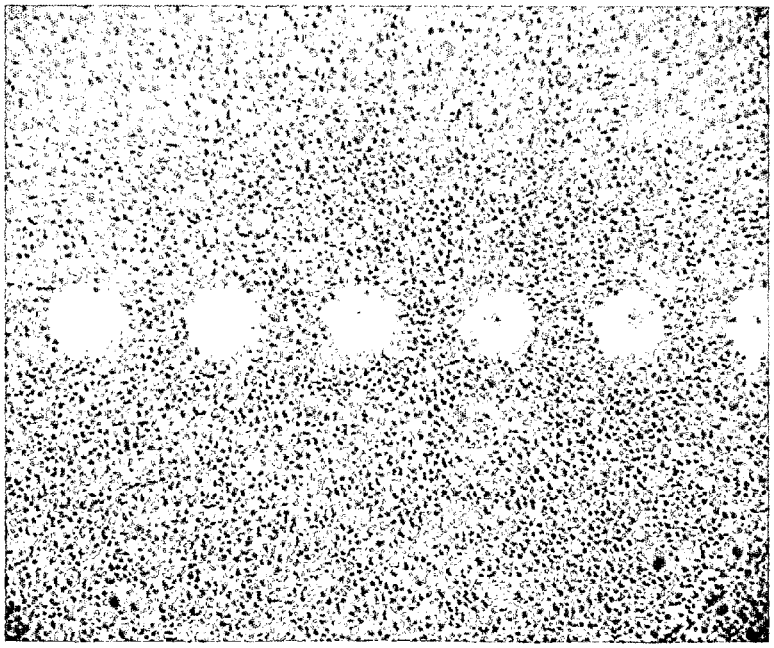
FIG. 12 is an optical micrograph of a patterned coating formed according to Example 8.

The patterned bead containing coating was imaged using an Olympus BX-51 microscope with Differential Interference Contrast (DIC) optics and 5× objective as shown in FIG. 12.

Example 9

Figure 13:
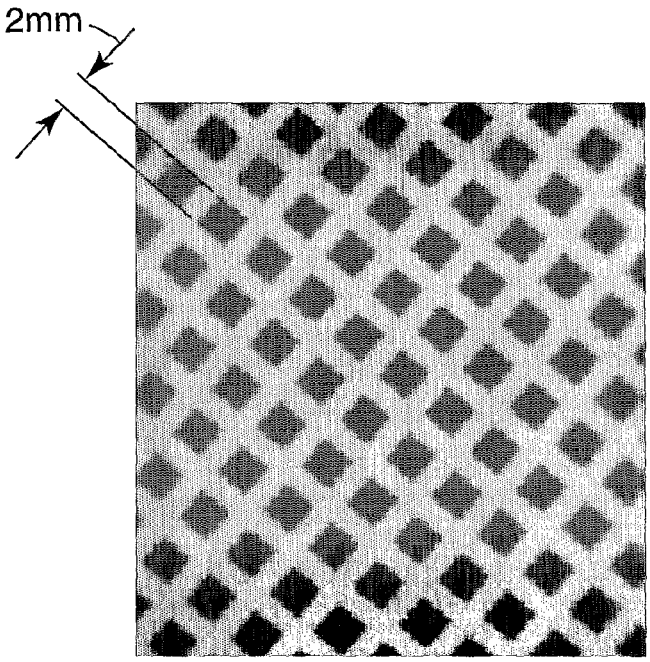
FIG. 13 is a top view schematic diagram of an energy transfer surface pattern according to Example 9.
Figure 14:
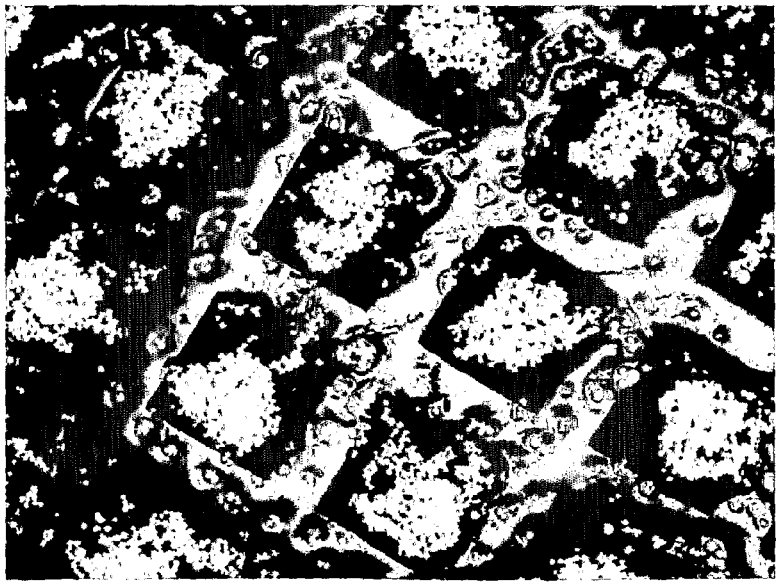
FIG. 14 is a photomicrograph of a dried, patterned coating formed according to Example 9.

A morphologically and topographically patterned coating was prepared by coating a mixture consisting of 4.4% by weight white wax beads, 9.3% by weight polyvinyl butyral (Butvar-B79) in a solvent blend (31.7% by weight toluene and 54.6% by weight ethanol) onto a polymer test sheet. The sheet consisted of a clear polymer film coated with a photographic emulsion and exposed to create a test pattern of black squares, as shown in FIG. 13. The test sheet thickness was 107 micrometers. The coating was cast onto the image side of the test sheet using a BWK Gardner Multiple Clearance Applicator with a gap setting of 635 micrometers. The wax beads were initially randomly dispersed in the coating on the film. The coated film was then placed (coating facing upward) onto a frame 27 cm above a 250 watt SLI Lighting heat lamp. A glass cover sheet was then positioned 6.5 mm above the test sheet. The coating on the film was then allowed to dry for approximately 10 minutes. A photomicrograph of the dried, patterned coating is shown in FIG. 14.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

We claim:

1. A method of forming a morphologically patterned coating comprising the steps of:

disposing a composition comprising a polymer or polymer precursors onto a substrate which is a sheet selected from the group consisting of polymeric films, paper, polymer-coated paper, rubber and laminates of polymers, to form a liquid coating on the substrate;

providing energy to the polymer or polymer precursor composition from an energy source selected from the group consisting of an infrared source, a heat lamp, a heated metal plate, a heated metal roll over which the substrate is transported and a laser beam through a first pattern of areas selected from the group consisting of a pattern on the heated metal plate or a polymer film, a pattern on the heated metal roll and a pattern created by chopping the laser beam to form a morphologically patterned coating, a morphological pattern in a coating being defined as a pattern of parts of the coating having a composition, or porosity that differs from the remaining parts of the coating, the morphological pattern corresponding to the first pattern of areas; and solidifying the morphologically patterned coating by polymerizing, cross-linking, curing, drying or freezing the coating.

2. A method according to claim 1 in which the substrate is disposed between the energy source and the liquid coating.

3. A method according to claim 1 wherein the composition further comprises suspended particles having a mean diameter in the range of 5 nanometers to 1 millimeter, and the morphological pattern is a pattern of the particles.

4. A method according to claim 1 wherein the disposing step comprises disposing a composition comprising a polymer or polymer precursor and a liquid vehicle onto a substrate to form a liquid coating on the substrate.

5. A method according to claim 4 further comprising removing the liquid vehicle component from the coating.

6. A method according to claim 1 wherein the solidifying step comprises exposing the morphologically patterned coating to ultraviolet radiation.

7. A method according to claim 2 wherein the energy source is an energy transfer surface selected from the group consisting of a patterned plate and a patterned roll over which the substrate is transported.

8. A method according to claim 1 wherein energy is removed from one side of the liquid coating and provided to the other side from a source external to the coating simultaneously to form the morphologically patterned coating.

9. A method according to claim 1 wherein the composition comprises a film forming material that forms a pressure sensitive adhesive selected from the group consisting of block copolymers, tackified elastomers, water-based latex, acrylate-based and silicon-based pressure sensitive adhesives.

10. A method of forming a morphologically patterned coating comprising the steps of:

disposing a composition comprising a film forming material that forms a pressure sensitive adhesive selected from the group consisting of block copolymers, tackified elastomer, water-based latex, acrylate-based and silicon-based pressure sensitive adhesives onto a substrate which is a sheet selected from the group consisting of polymeric films, paper, polymer-coated paper, rubber and laminates of polymers to form a liquid coating on the substrate;

providing energy to the pressure sensitive adhesive forming composition from an energy source selected from the group consisting of a heated metal plate on the side of the substrate opposite the liquid coating, a heated metal roll over which the substrate is transported and a laser beam directed through a pattern of areas selected from the group consisting of a pattern on the heated metal plate, a pattern on the heated metal roll and a pattern created by chopping the laser beam to form a morphologically patterned coating, the morphological pattern corresponding to the pattern of areas, a morphological pattern being defined as a pattern of parts of the coating having a composition, or porosity that differs from the remaining parts of the coating; and solidifying the morphologically patterned coating by polymerizing, cross-linking, curing, drying or freezing the coating.

11. A method of forming a morphologically patterned coating comprising the steps of:

disposing a composition comprising a polymer or polymer precursors onto a substrate which is a sheet selected from the group consisting of polymeric films, paper, polymer-coated paper, rubber and laminates of polymers, to form a liquid coating on the substrate;

cooling the polymer or polymer precursor composition through a first pattern of areas on an energy transfer surface selected from the group consisting of a patterned plate on the side of the substrate opposite the liquid coating and a patterned roll over which the substrate is transported to form a morphologically patterned coating, a morphological pattern in a coating being defined as a pattern of parts of the coating having a composition, or porosity that differs from the remaining parts of the coating, the morphological pattern corresponding to the first pattern of areas; and solidifying the morphologically patterned coating by polymerizing, cross-linking, curing, drying or freezing the coating.

12. A method according to claim 11 further comprising solidifying the morphologically patterned coating by exposing it to ultraviolet radiation.

13. A method according to claim 11 wherein the composition further comprises suspended particles, and the morphological pattern is a pattern of the particles.

14. A method according to claim 11 wherein the disposing step comprises disposing a composition comprising a polymer or polymer precursor and a liquid vehicle onto a substrate to form a liquid coating on the substrate.

15. A method according to claim 14 further comprising removing the liquid vehicle component from the coating.

16. A method according to claim 11 wherein the composition comprises a film forming material that forms a pressure sensitive adhesive selected from the group consisting of block copolymer, tackified elastomer, water-based latex, acrylate-based and silicon-based pressure sensitive adhesives.

* * * * *

UNITED STATES PATENT AND TRADEMARK OFFICE

CERTIFICATE OF CORRECTION

PATENT NO. : 8,993,059 B2
APPLICATION NO. : 11/815468
DATED : March 31, 2015
INVENTOR(S) : Peter Price It is certified that error appears in the above-identified patent and that said Letters Patent is hereby corrected as shown below:

In The Specification
Column 8
Line 30, Delete "110° C." and insert -- 10° C. --, therefor.

Signed and Sealed this
Nineteenth Day of January, 2016

Michelle K. Lee

Michelle K. Lee
*Director of the United States Patent and Trademark Office*